United States Patent [19]

King et al.

[11] Patent Number: 4,792,167

[45] Date of Patent: Dec. 20, 1988

[54] RELEASABLE BOLT DEVICES FOR SECURING DOORS

[76] Inventors: James C. King, "Fourwinds", 19 Bath Road, Frome, Somerset; Michael A. Cooper, Dinas Crest, Melbury Abbas, Shaftesbury, Dorset, both of England

[21] Appl. No.: 927,244

[22] Filed: Nov. 4, 1986

[51] Int. Cl.[4] ..... E05B 39/02; E05C 1/02

[52] U.S. Cl. ..... 292/179; 70/422; 70/DIG. 57; 292/148; 292/151; 292/331

[58] Field of Search ..... 292/179, 151, 150, 148, 292/154, 331, 327, 177, 178, 180, 181; 70/DIG. 57, 422, 432

[56] References Cited

U.S. PATENT DOCUMENTS

| | | | |
|---|---|---|---|
| 161,023 | 3/1875 | Gale et al. | 292/148 X |
| 269,033 | 12/1882 | Ellsworth | 292/148 X |
| 271,001 | 1/1883 | Thompson | 292/180 |
| 363,801 | 5/1887 | Chapman | 292/151 |
| 643,850 | 3/1900 | Rogers | 292/181 |
| 908,864 | 1/1909 | Hopton | 70/422 |
| 1,311,500 | 7/1919 | Dresser | 292/327 |
| 1,751,779 | 3/1930 | Von Senden | 70/230 |
| 1,888,859 | 11/1932 | Just | 70/422 |
| 1,908,241 | 5/1933 | Heeren et al. | 292/327 |
| 3,126,218 | 3/1964 | Andrews | 70/432 |
| 4,005,886 | 2/1977 | Livette | 292/177 |
| 4,196,602 | 4/1980 | Akselsen | 70/DIG. 57 X |
| 4,548,061 | 10/1985 | Nilsson | 70/DIG. 57 X |

FOREIGN PATENT DOCUMENTS

| | | | |
|---|---|---|---|
| 1420935 | 1/1976 | United Kingdom | 292/150 |

*Primary Examiner*—Lloyd A. Gall

*Attorney, Agent, or Firm*—Plante, Strauss & Vanderburgh

[57] ABSTRACT

A releasable bolt device 1 for securing an emergency exit door 2 comprises a support structure 3 of box-like form, a bolt member 4 slidably mounted on the structure 3 for movement relative thereto, a compression spring 5 for urging the bolt member 4 away from the door-securing position, a frangible keep member 6, and a plate 7 for retaining the keep member 6 in place whereby its presence maintains the bolt member 4 in a door-securing position. The frangible keep member 6 is weakened locally so that it may be deliberately broken at that locality by manual force applied to it, whereby the bolt member 4 is moved out of its door-securing position by the spring 5.

12 Claims, 5 Drawing Sheets

1
2
3
4
5
6
7
10
11
12
13
14
15
16
17
18
20
21
30
31
32
37
40

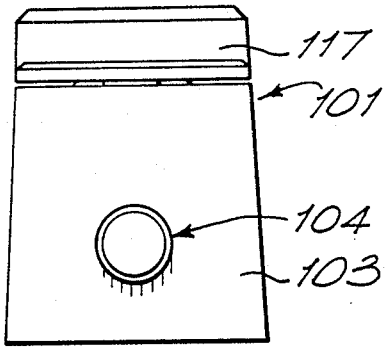
FIG.12.
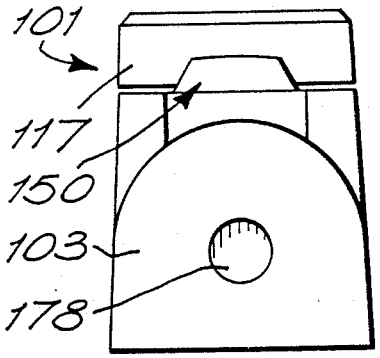
FIG.13.
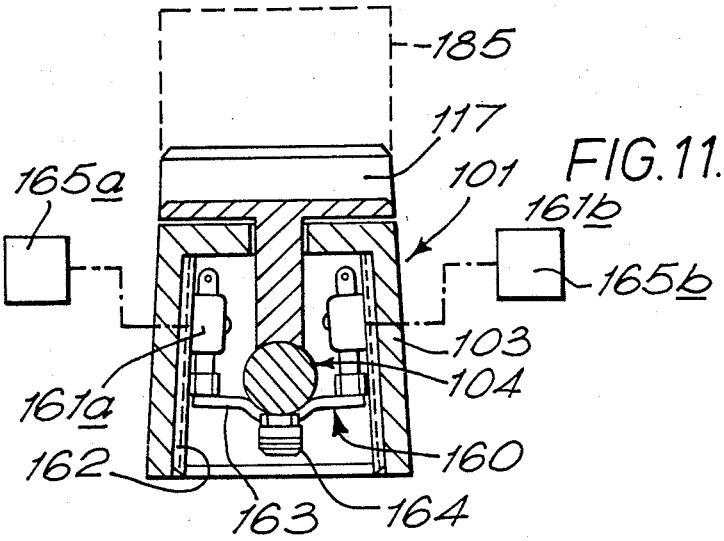
FIG.11.
FIG.14.
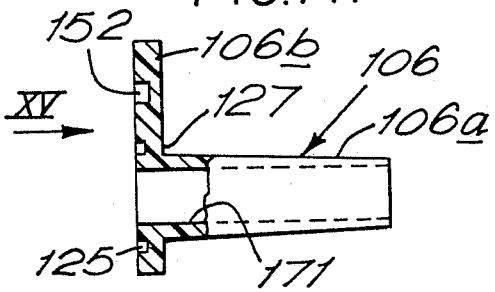
FIG.15.
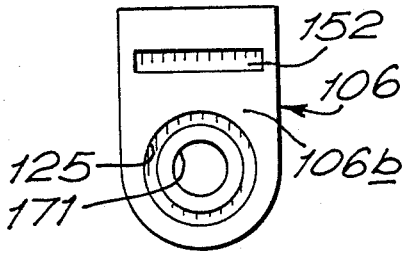

RELEASABLE BOLT DEVICES FOR SECURING DOORS

BACKGROUND OF THE INVENTION

This invention relates to releasable bolt devices for securing doors.

The invention is primarily concerned with releasable bolt devices for securing emergency exit doors, sometimes known as "panic bolts". However, the invention has application to releasably securing the doors of lockers, cabinets, cupboards etc. holding equipment to be used only in an emergency.

SUMMARY OF THE INVENTION

According to the invention, a releasable bolt device for securing a door comprises a support structure, a bolt member mounted on the support structure for movement relative thereto, means for urging the bolt member away from a door-securing position, a frangible keep member, and means for retaining the keep member in place whereby its presence maintains the bolt member in a door-securing position, the frangible member being weakened locally so that it may be deliberately broken at that locality by manual force applied to it, so as to allow the bolt member to be moved out of its door-securing position.

The frangible keep member is preferably of plastics material and preferably comprises a lever portion integral with a flange portion, the two portions being connected by a weakened junction.

Retaining means are preferably provided whereby, once the frangible keep member is placed in position so that the bolt member is maintained in a door-securing position, the keep member cannot be removed without it being broken.

The retaining means preferably comprise a spring-loaded catch cooperable wit a recess formed in the frangible keep member.

BRIEF DESCRIPTION OF THE DRAWINGS

An embodiment of the invention will now be described by way of example only, with reference to the accompanying drawings, wherein:

FIG. 11 is an end view in full section, taken on the lines XI—XI of FIG. 10, FIGS. 12 and 13 are end views looking, respectively, in the direction of arrows XII and XIII of FIG. 8, FIG. 14 is a side view, in medial section, of the frangible keep member of the modified device, and FIG. 15 is an end view, looking in the direction of arrow XV of FIG. 14.

In the figures, like reference numerals refer to like components.

DETAILED DESCRIPTION OF THE PREFERRED EMBODIMENT

Figures 1, 2, 3:
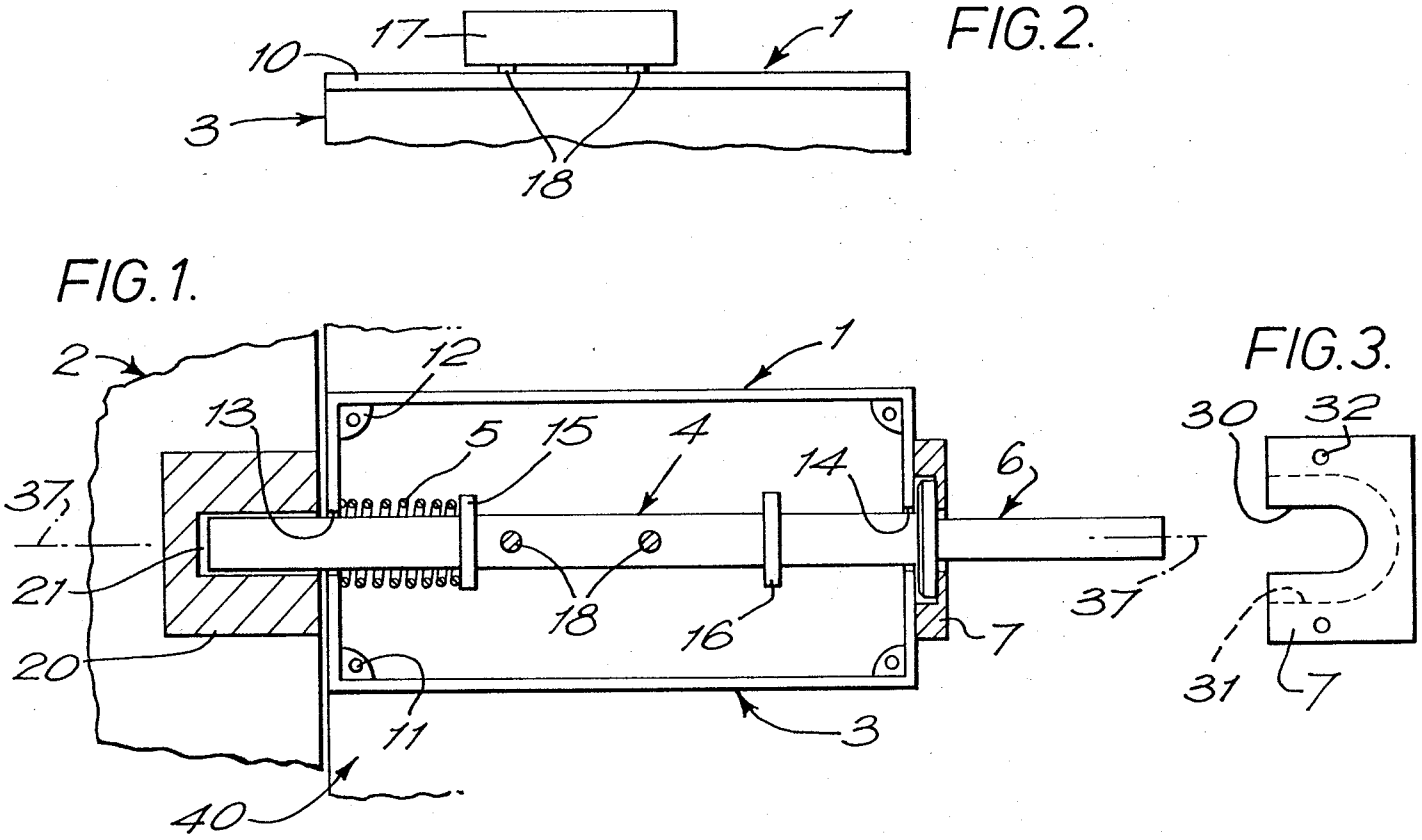
FIG. 1 is a side view, in section, of the releasable bolt device.
FIG. 2 is a fragmentary side view of the device.
FIG. 3 is an end view of part of the device.
Figure 5:
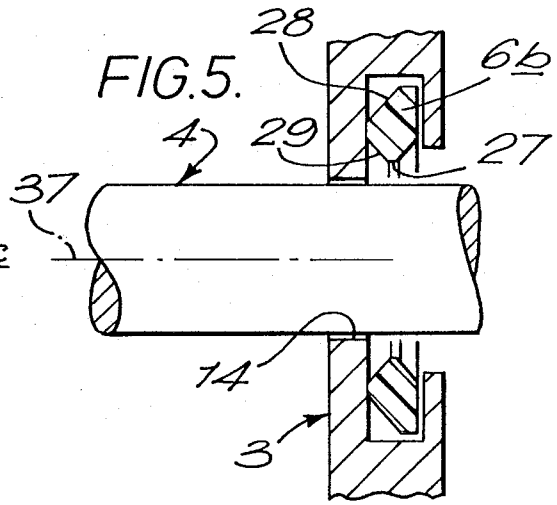
FIG. 5 is a similar view of one portion of the device, after deliberate breakage.

With reference to FIGS. 1 to 6, particularly FIG. 1, a releasable bolt device 1 for securing an emergency exit door 2 comprises a support structure 3 of box-like form, a bolt member 4 slidably mounted on the structure 3 for movement relative thereto, means comprising a compression spring 5 for urging the bolt member 4 away from the door-securing position, (as in FIG. 6), a frangible keep member 6, and means comprising a plate 7 for retaining the keep member 6 in place whereby, (as in FIG. 1), its presence maintains the bolt member 4 in a door-securing position, the frangible keep member 6 being weakened locally so that it may be deliberately broken at that locality by manual force (leverage) applied to it, so as to allow the bolt member 4 to be moved out of its door-securing position. (See FIG. 6).

The device 1 is secured to the jamb 40 of the door 2. The support structure 3 has a releasable cover 10, (FIG. 2), secured in place by screws located by holes 11 in landings 12 formed within the box-like structure. The bolt member 4 is slidably located by aligned holes 13, 14 formed in opposite ends of the support structure 3.

The comrpession spring 5 is located between a collar 15 secured to the bolt member 4 and the adjacent end wall of the support structure 3. A collar 16 is also secured to the bolt member 4 and is spaced axially from the collar 15. A bolt member actuating handle 17 is secured to the bolt member 4 by pillars 18. A slot (not shown) formed in the cover 10 allows free movement of the pillars 8 and thus the handle 17.

The emergency door 2 is provided with a bolt keeper 20, having a socket 21 for receiving one end of the bolt member 4.

Figure 4:
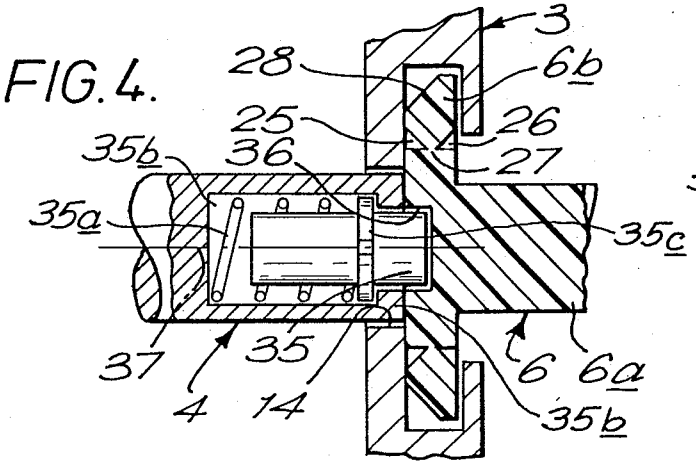
FIG. 4 is a fragmentary side view, in medial section, and to an enlarged scale, of the frangible keep member of the device.
Figure 6:
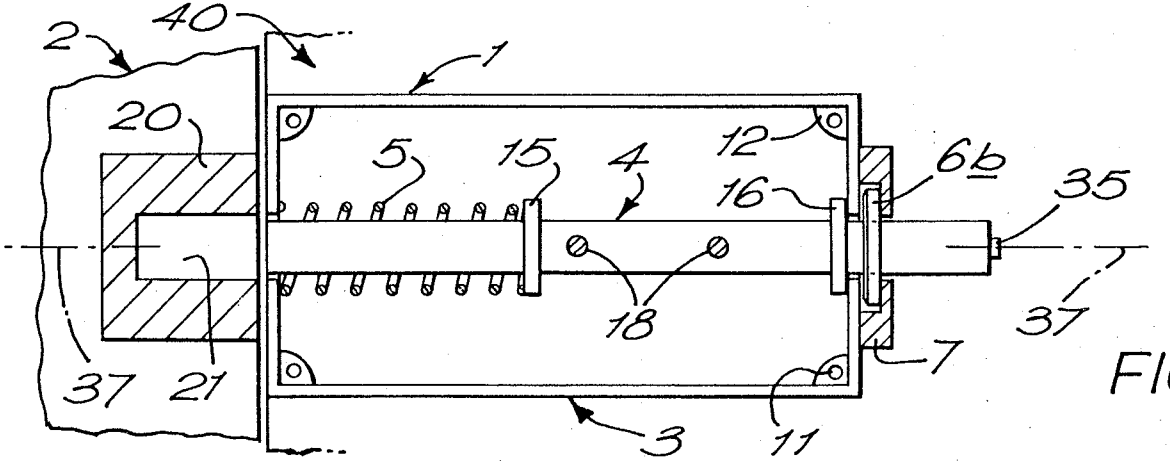
FIG. 6 is a view similar to FIG. 1 and illustrates the device in a door-release condition.

With particular reference to FIG. 4, the frangible keep member 6 is of plastics material and comprises a lever portion **6*a* integral with a circular flange portion 6*b*. Annular grooves 25, 26 are formed in opposite faces of the flange portion 6*b* so that the portions 6*a*, 6*b* of the keep member 6 are connected by a weakened junction 27. The portion 6*b* is provided with a chamfer 28**.

The retaining place 7, (see FIG. 3), has round-ended slots 30, 31 formed in it. Slot 30 receives the tubular portion **6*a* of the keep member 6, and slot 31 the flange portion 6*b* thereof. The plate 7 is secured to the support structure 3 by screws located by holes 32**.

With reference to FIG. 4 once again, the device is provided with means whereby, once placed in position so that the bolt member 4 is maintained in the door-securing position, (of FIG. 1), the frangible keep member 6 cannot be removed without being broken.

Such means comprise a spring-loaded catch member 35 located in the adjacent end of the bolt member 4 and cooperating with a recess 36 formed in the keep member 6. Both the catch member 35 and recess 36 are of circular cross-section. The spring-loading arrangement of the catch member 35 comprises a compression spring **35*a* housed in a recess 35*b* formed in the end of the bolt member 4. The spring is held in place by a "Circlip" 35*c* or similar fastener and the catch member 35 is provided with a stop 35*d*** which limits its spring-induced movement.

In operation, the lever 17 is used to move the bolt member 4, against the action of the spring 5, into a door-securing position. This also allows the frangible keep member 6 to be slid sideways into the slot 31, to assume the position shown in FIGS. 1 and 4. The catch member 35 is deflected, against its spring loading as the keep member 6 is fitted in place. Once the keep member 6 is in place, the catch member 35 is free to move into the recess 36. The keep member 6 cannot now be displaced, unless broken, or, in this example, unless the retaining plate 7 is removed. To prevent unauthorised removal of the plate 7, the above-mentioned modification is preferred.

In the event of fire, or other emergency, the frangible keep member 6 is broken by manual leverage applied to the tubular portion 6*a*. Such leverage can be applied in any sideways direction relative to the longitudinal axis 37 of the bolt member 4, and results in local fracture at the weak junction 27.

Fracture of the junction 27 allows the spring 5 to thrust the bolt member 4 through the hole now formed in the center of the flange portion 6*b*, (which hole is bounded by the remains of the annular groove 25), until this axial movement of the bolt member 4 is arrested by contact between the collar 16 and the adjacent end wall of the box-like structure 3. (see FIG. 6). This axial movement of the bolt member 4 results in clear withdrawal of the bolt member from the bolt keeper 20.

Subsequently, a replacement keep member 6 is fitted, after removal of the portion 6*b*, using the handle 17 to pull back the bolt member 4. The chamfer 28 facilitates installation of the replacement keep member. Chamfer 29 (FIG. 5), formed by fracture of the keep member 6, facilitates easy removal of the portion 6*b* left in place after fracture.

The frangible keep member 6 may be of metal, comprising, for example, a zinc or aluminium diecasting. The member 6 may be colored so as to make it more prominent. Preferably a fluorescence coloring is employed.

Alternatively, or in addition, the keep member 6 may be illuminated. A self-luminous source may be used. For example, by one of the devices manufactured and marketed by Saunders-Roe Developments Limited under the trade mark "Betalight".

The portion 6*a* of the keep member 6 may be of tubular form to assist moulding or casting. The resulting recess may be used to house one of the above-mentioned "Betalight" sources.

The device 1 has obvious advantages over currently used devices wherein breakage of a glass tube by a small hammer has to take place in order to release an emergency door. Not only does the presence of glass in the vicinity of the door represent a hazard, one may also have to grope, blinded by smoke, not only to find the hammer, but to find the glass tube.

Figure 7:
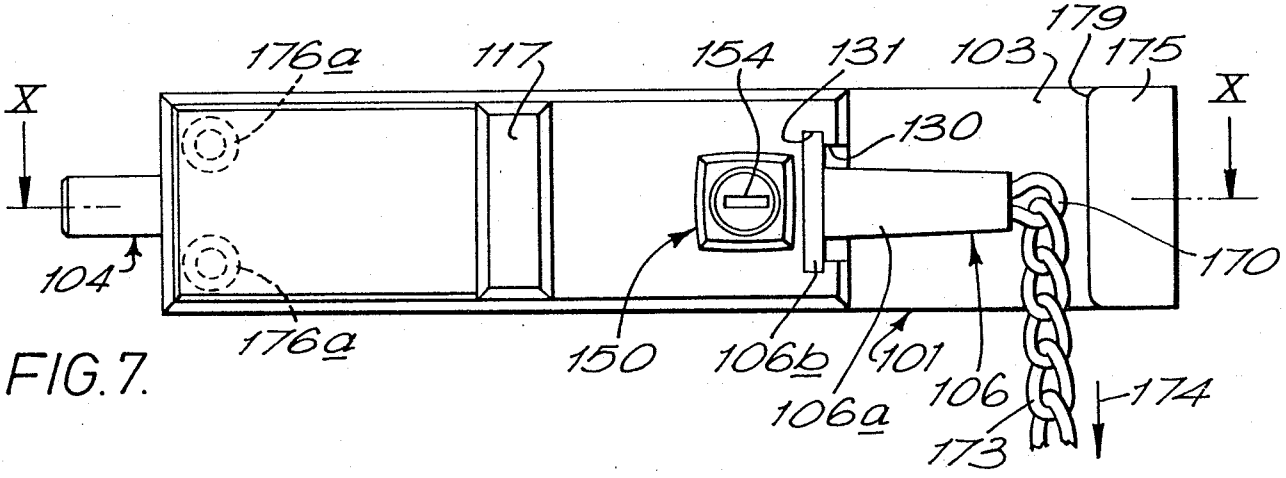
FIGS. 7, 8 and 9 are, respectively, plan, side and underneath views of a modified bolt device.
Figure 8:
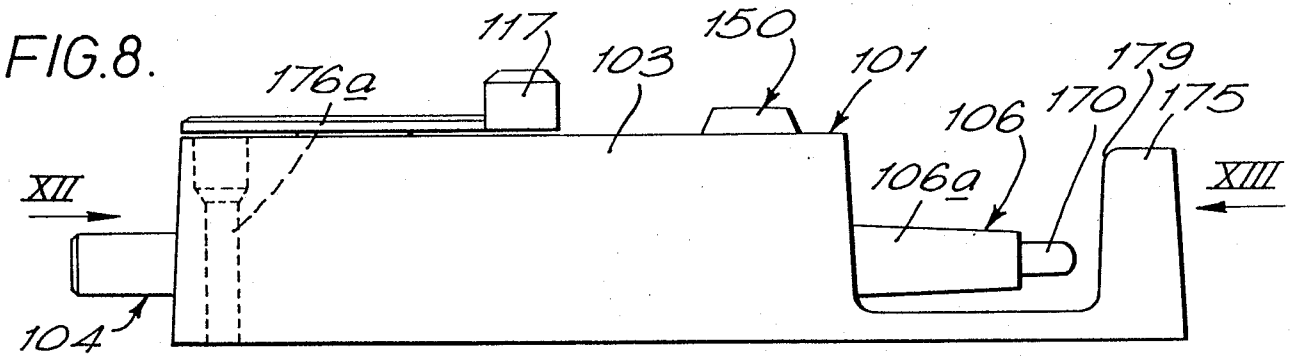

FIGS. 7 to 15 illustrate a releasable bolt device 101 having a structure 103 comprising a die-casting, formed with slots 130, 131 (FIG. 7). Slot 130 receives a tapered, tubular portion 106*a* of the frangible keep member 106, (FIGS. 14 and 15) and slot 131 receives the flange portion 106*b* thereof.

The device 101 is provided with releasable retaining means operable whereby the keep member 106 may be removed without it being broken. Thus an emergency door may be opened, perhaps for inspection purposes, without the need to break the keep member 106.

The releasable retaining means comprises a key-operated locking assembly 150 comprising a mortise-like locking element 151 (FIG. 10) releasably engageable with a slot 152 formed in the flange portion 106*b* of the keep member 106. The locking element 151 enters, and can be withdrawn from the slot 131 by way of a slot 153 formed in the structure 103. (See FIG. 10).

By inserting a "YALE" type key (not shown), in the keyhole 154 of the assembly 150, and by turning the key while holding back the bolt member 104, using the actuating handle 117, the keep member 106 can easily be removed from the device 101.

Figure 10:
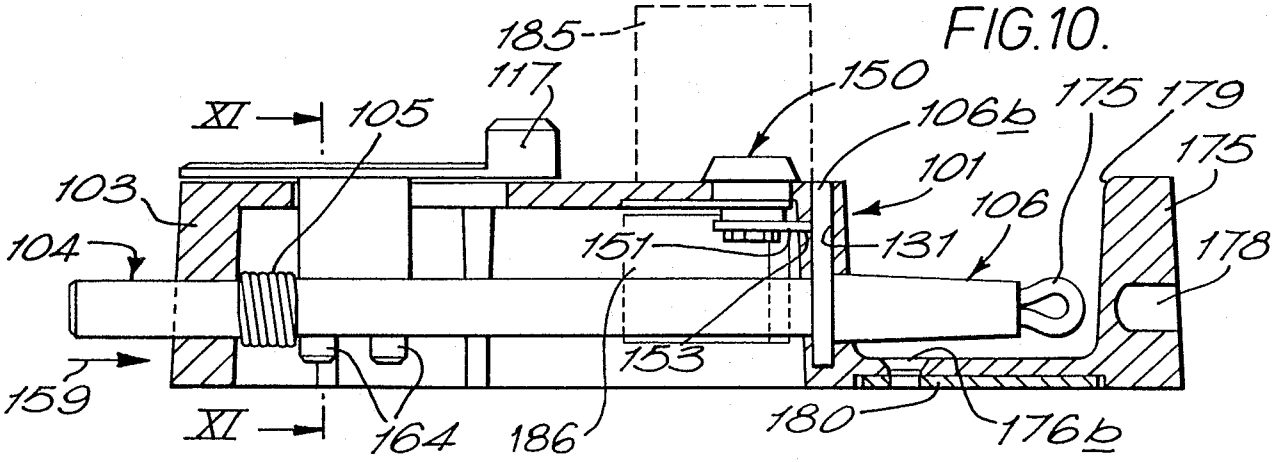
FIG. 10 is a side view in section, taken on the lines X—X of FIG. 7.

With reference to FIGS. 10 and 11, means are provided whereby at least on signal is emitted when the bolt member 104 is urged away from a door-securing position, in the direction indicated by arrow 159.

These means, generally indicated by reference numeral 160, and located between ribs 162 formed within the structure 103, comprise micro-switches 161*a*, 161*b* which, when actuated by contact of a striker 163 carried by the bolt member 104, initiate operation of independent signal-emitting units 165*a*, 165*b*. The striker 163 is secured in place by screws 164 which also attach the handle 117 to the shaft 104.

The signal-emitting units 165*a*, 165*b*, which may be battery-operated, emit an audible and a light flashing signal respectively. Alternatively, or in addition, at least one of the units 165*a*, 165*b* may be connected to a central and remote control system, to which other bolt devices 101 (or 1) are connected.

As best seen with reference to FIG. 7, leverage means may be provided whereby a manual pulling force may be applied to the frangible keep member 106 so as to break it at the weakened junction 127, resulting, at least in part, in the presence of the groove 125.

FIG. 7 shows a pin 170 inserted in the bore 171 of the keep member 106. The pin 170 carries a chain 173, which, in order to break the keep member 106, is pulled, as indicated by the arrow 174, whereupon the pin 170 and tubular portion 106*a* of the keep member fall away, clear of the bolt device 101, allowing the bolt member 104 to be moved out of a door-securing position by the spring 105. The chain 173 is secured by an anchorage (not shown) located in a recess 178 (FIG. 10) formed in a stop 175 which prevents unauthorised withdrawal of the pin 170. The stop 175 has a peripheral radius 179 which ensures that, regardless of the direction of pull, when the chain 173 is dragged against the stop, sufficient force will be applied to the keep member 106 to break it.

The handle 117 is formed so that it covers two of three mounting screws located by holes 176*a* when the device 101 is in a door-securing position. Access to these screws can only be gained when the handle 117 is allowed to be moved to the right, as viewed in FIG. 8. A third fixing screw is sited in a hole 176*b* beneath the tubular portion 106*a* of the keep member 106. (See FIG. 10).

To lessen the possibility of the device 101 being operated from the other side of the door, by unauthorised persons drilling through the door and breaking the keep member 106, a hardened steel plate 180 is positioned in a recess 181 formed in the support structure 103.

Thus it can be said that the device 101 is formed and constructed so that access to fixing screws securing the device to a door is prevented when the keep member 106 is in positiion.

To enable the device 101 to be compatible with a master key security system, an extension lock 185 can be provided which, when mounted on the structure 103 as shown in broken lines, will accommodate a range of rim cylinder locks to replace or supplement the key assembly 150.

The bolt member 104 is preferably case hardened to at least impede cutting it with a file or hacksaw.

Figure 9:
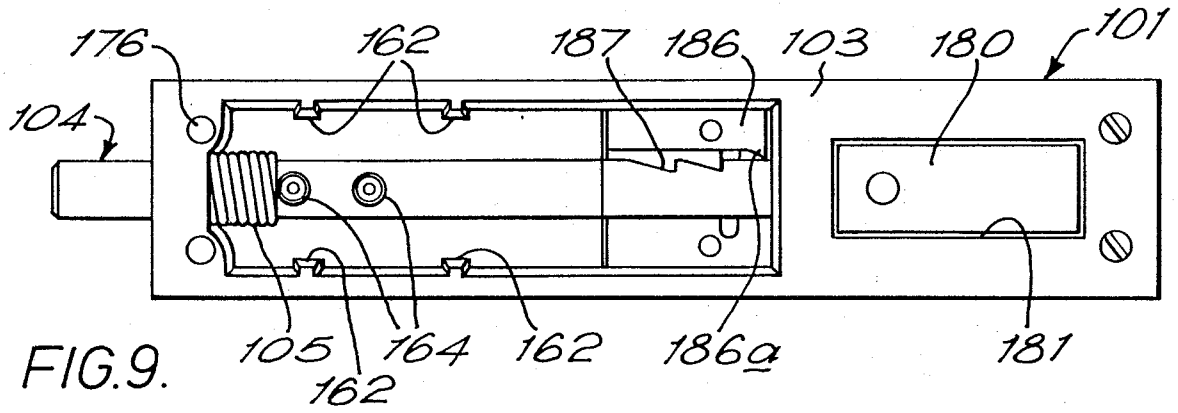

With reference to FIG. 9, the locking element 151 (FIG. 10) of the locking assembly 150 is kept firmly in place by a spring clip 186 of hollow form which also serves to prevent resetting of the device 101 without the use of a key. Notches 187 formed in the bolt member 104 cooperate with the spring clip 186 to prevent resetting when a projection 186*a* of the resilient clip 186 engages with one of these notches.

When the locking element 151 is turned by its key in order to reset the device 101, the element bears against the clip 186, so as to compress it, whereby the projection 186*a* of the clip is withdrawn from the notch 187, to allow free passage of the bolt member 104.

Where possible one or more of the features of the device 101 may be combined with or substituted for features of the device 1.

We claim:

1. A releasable bolt device for use in combination with a bolt keeper to secure a door comprising a support structure, an elongate bolt member mounted on the support structure for slidable movement relative thereto along a path coextensive with the longitudinal axis of the bolt member, between a door-securing position in said bolt keeper and a door-releasing position withdrawn from said bolt keeper, biasing means for urging the bolt member away from said door-securing position, a frangible keep member and means for retaining the keep member in place whereby it obstructs movement of the bolt member by the biasing means in a direction away from the door-securing position, the frangible member being weakened locally so that it may be deliberately broken at that locality by manual force applied to it, releasing said bolt member and allowing the bolt member to move out of its door-securing.

2. A bolt device as claimed in claim 1, wherein the frangible keep member comprises a lever portion integral with a flange portion, the two portions being connected by a weakened junction.

3. A bolt device as claimed in claim 1, provided with retaining means operable so that once the frangible keep member is placed in position to maintain the bolt member in a door-securing position, the keep member cannot be removed without it being broken.

4. A bolt device as claimed in claim 1, provided with retaining means operable so that once the frangible keep member is placed in position to maintain the bolt member in a door-securing position, the keep member cannot be removed without it being broken, said retaining means comprising a spring-loaded catch cooperable with a recess formed in the frangible keep member.

5. A bolt device as claimed in claim 1, provided with releasable retaining means operable whereby the frangible keep member may be removed without it being broken.

6. A bolt device as claimed in claim 1, provided with releasable retaining means operable whereby the frangible keep member may be removed without it being broken, said releasable retaining means comprising a locking element releasably engageable with a portion of the frangible keep member.

7. A bolt device as claimed in claim 1, provided with signal-emitting means operable when the bolt member is urged away from a door-securing position.

8. A bolt device as claimed in claim 1, including at least one aperture to receive fixing screws for securing the device to a door, which at least one aperture is located adjacent the position of said frangible keep member to be covered thereby when said frangible keep member is in position.

9. A bolt device as claimed in claim 1, provided with means operable to prevent resetting of the device after breakage of the keep member.

10. A bolt device of claim 9 including key operated lock means rotatable between locked and unlocked positions and having an arm movable into contact with said keep member.

11. A bolt device as claimed in claim 1, provided with leverage means for breakage of the keep member.

12. A bolt device of claim 1 wherein said frangible member is weakened in a pattern, which when said member is broken, exposes a hole therethrough which is aligned with said bolt member, whereby said bolt member moves out of its door-securing position by way of said hole.

* * * * *

UNITED STATES PATENT AND TRADEMARK OFFICE

CERTIFICATE OF CORRECTION

PATENT NO. : 4,792,167

DATED : December 20, 1988

INVENTOR(S) : James C. King and Michael A. Cooper

It is certified that error appears in the above-identified patent and that said Letters Patent is hereby corrected as shown below:

Claim 1, column 5, line 38, after "door-securing" insert --position --

Signed and Sealed this

Ninth Day of May, 1989

*Attest:*

DONALD J. QUIGG

*Attesting Officer*

*Commissioner of Patents and Trademarks*